US011020794B2

(12) United States Patent
Furumai et al.

(10) Patent No.: US 11,020,794 B2
(45) Date of Patent: Jun. 1, 2021

(54) CONTINUOUS CASTING MOLD AND METHOD FOR CONTINUOUSLY CASTING STEEL

(71) Applicant: JFE STEEL CORPORATION, Tokyo (JP)

(72) Inventors: Kohei Furumai, Tokyo (JP); Norichika Aramaki, Tokyo (JP); Yuji Miki, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 16/342,576

(22) PCT Filed: Oct. 16, 2017

(86) PCT No.: PCT/JP2017/037331

§ 371 (c)(1),
(2) Date: Apr. 17, 2019

(87) PCT Pub. No.: WO2018/074406

PCT Pub. Date: Apr. 26, 2018

(65) Prior Publication Data

US 2020/0055113 A1 Feb. 20, 2020

(30) Foreign Application Priority Data

Oct. 19, 2016 (JP) ..... JP2016-204987

(51) Int. Cl.
*B22D 11/059* (2006.01)
*B22D 11/04* (2006.01)

(52) U.S. Cl.
CPC ..... *B22D 11/059* (2013.01); *B22D 11/0406* (2013.01)

(58) Field of Classification Search
CPC . B22D 11/055; B22D 11/059; B22D 11/0406; B22D 11/112; B22D 11/124;
(Continued)

(56) References Cited

U.S. PATENT DOCUMENTS

2005/0115695 A1 6/2005 Mangler et al.
2015/0258603 A1 9/2015 Nabesima et al.

FOREIGN PATENT DOCUMENTS

CN 1649685 A 8/2005
CN 103317109 A 9/2013
(Continued)

OTHER PUBLICATIONS

English Translation of Suzuki et al. JP-H01-170550 (Year: 1989).*
(Continued)

*Primary Examiner* — Kevin P Kerns
*Assistant Examiner* — Steven S Ha
(74) *Attorney, Agent, or Firm* — Oliff PLC

(57) ABSTRACT

A continuous casting mold including a water-cooled copper mold having a mold copper plate including an inner wall surface, recessed portions disposed partially or entirely in a region of the inner wall surface of the water-cooled copper mold from at least a position located at a meniscus to a position located 20 mm lower than the meniscus, and material-filled layers disposed in the recessed portions with a metal or nonmetal having a thermal conductivity different from that of the mold copper plate of the water-cooled copper mold. A shape of each of the recessed portions at a surface of the mold copper plate includes a curved surface.

16 Claims, 7 Drawing Sheets

(58) Field of Classification Search
CPC .. B22D 11/1243; B22D 11/1245; B22D 11/22
See application file for complete search history.

(56) References Cited

FOREIGN PATENT DOCUMENTS

| | | | |
|---|---|---|---|
| CN | 104395015 | A | 3/2015 |
| CN | 105728673 | A | 7/2016 |
| EP | 2733230 | A1 | 5/2014 |
| EP | 2 839 901 | A1 | 2/2015 |
| EP | 2835191 | A1 | 2/2015 |
| JP | H01-170550 | A | 7/1989 |
| JP | H1-289542 | A | 11/1989 |
| JP | H02-006037 | A | 1/1990 |
| JP | H02-06038 | A | 1/1990 |
| JP | H07-284896 | A | 10/1995 |
| JP | H08-281382 | A | 10/1996 |
| JP | H9-276994 | A | 10/1997 |
| JP | H10-29043 | A | 2/1998 |
| JP | 2001-105102 | A | 4/2001 |
| JP | 2005-297001 | A | 10/2005 |
| JP | 2013-212518 | A | 10/2013 |
| JP | 2014-188521 | A | 10/2014 |
| JP | 2015-006695 | A | 1/2015 |
| JP | 2015-051442 | A | 3/2015 |
| RU | 2203158 | C2 | 4/2003 |
| SU | 904879 | A1 | 2/1982 |
| WO | 99/16564 | A1 | 4/1999 |
| WO | 2013-051380 | A1 | 4/2013 |

OTHER PUBLICATIONS

Jun. 29, 2018 Office Action issued in Taiwanese Patent Application No. 106135887.
Jun. 17, 2019 Extended European Search Report issued in European Patent Application No. 17861714.8.
Dec. 12, 2017 International Search Report issued in International Application No. PCT/JP2017/037331.
Jun. 8, 2020 Office Action issued in Korean Patent Application No. 10-2019-7010687.
Jan. 29, 2020 Office Action issued in Russian Patent Application No. 2019111906.
Aug. 12, 2020 Office Action issued in Chinese Patent Application No. 201780064112.5.

* cited by examiner (A)

(B)

(A)

(B)

CONTINUOUS CASTING MOLD AND METHOD FOR CONTINUOUSLY CASTING STEEL

TECHNICAL FIELD

This application relates to a continuous casting mold including dissimilar material-filled layers filled with a metal or nonmetal having a thermal conductivity different from that of a mold copper plate, which are disposed in a region of an inner wall surface of the mold where a meniscus is located, the continuous casting mold being capable of continuously casting molten steel while suppressing surface cracks in a cast piece due to uneven cooling of a solidified shell in the mold, and to a method for continuously casting steel using the continuous casting mold.

BACKGROUND

In continuous casting of steel, cast pieces with a predetermined length are produced as described below. Molten steel poured into a mold is cooled by a water-cooled mold, and the molten steel solidifies at the contact surface with the mold to form a solidified layer (hereinafter, referred to as a "solidified shell"). The solidified shell, together with a non-solidified layer inside, is continuously drawn downward through the mold while being cooled with water spray or air water spray installed on the downstream side of the mold. In the drawing process, the central portion is also solidified by cooling with water spray or air water spray, and then, cutting is performed using a gas cutter or the like to obtain cast pieces with a predetermined length.

When uneven cooling occurs in the mold, the thickness of the solidified shell becomes uneven in the casting direction and in the cast piece width direction. The solidified shell is subjected to stress due to shrinkage and deformation of the solidified shell. In the early stage of solidification, the stress concentrates on a thin part of the solidified shell, and a crack is generated by the stress on the surface of the solidified shell. The crack is made to grow to be a large surface crack by subsequent thermal stress and external forces, such as bending stress and leveling stress, which are applied by rolls of the continuous casting machine. In the case where the degree of unevenness in the thickness of the solidified shell is large, a longitudinal crack occurs in the mold, and in some cases, breakout may occur in which molten steel flows out from the longitudinal crack. The crack present on the surface of the cast piece becomes a surface defect of the steel product in the subsequent rolling process. Therefore, at the cast piece stage, it is necessary to remove the surface crack by grinding the surface of the cast piece.

Uneven solidification in the mold tends to occur, in particular, in the case of steel (referred to as "medium carbon steel") having a carbon content in the range of 0.08 to 0.17% by mass, in which a peritectic reaction takes place. The reason for this is considered to be that the solidified shell is deformed by strain caused by transformation stress due to volume shrinkage during transformation from δ iron (ferrite) to γ iron (austenite) in the peritectic reaction; because of the deformation, the solidified shell is detached from the inner wall surface of the mold; the thickness of the solidified shell is decreased at a portion detached from the inner wall surface of the mold (hereinafter, the portion detached from the inner wall surface of the mold is referred to as the "depression"); and since the stress concentrates on this portion, a surface crack occurs.

In particular, in the case where the cast-piece drawing speed is increased, the average heat flux from the solidified shell to the cooling water of the mold increases, i.e., the solidified shell is rapidly cooled, and the distribution of heat flux becomes irregular and uneven. Therefore, the occurrence of surface cracks in the cast piece tends to increase. Specifically, in a machine for continuously casting a slab having a cast-piece thickness of 200 mm or more, when the cast-piece drawing speed is 1.5 m/min or more, surface cracks tend to be generated.

Hitherto, there have been attempts in which, in order to suppress occurrence of surface cracks in medium carbon steel in which the peritectic reaction takes place, as proposed in Patent Literature 1, mold powder having a composition that is easily crystallized is used, and by increasing the thermal resistance of a mold powder layer, a solidified shell is slowly cooled. This technique aims to suppress occurrence of surface cracks by decreasing stress on the solidified shell by means of slow cooling. However, uneven solidification cannot be sufficiently improved only by the effect of slow cooling with use of the mold powder, and it is not possible to prevent surface cracks from occurring in the case of a steel grade having a large transformation amount.

Accordingly, there have been many proposals for methods to slowly cool a continuous casting mold itself.

Patent Literature 2 proposes a technique in which grating-shaped grooves with a depth of 0.5 to 1.0 mm and a width of 0.5 to 1.0 mm are provided on the inner wall surface of a mold near the meniscus, air gaps are forcibly formed by the grooves between a solidified shell and the mold, thereby slowly cooling the solidified shell and dispersing surface strain so that longitudinal cracks in a cast piece can be prevented. However, in this technique, in order to prevent mold powder from entering the grooves, it is necessary to decrease the width and depth of the grooves. Furthermore, since the inner wall surface of the mold is worn away by contact with the cast piece, the grooves provided on the inner wall surface of the mold become shallow, which gives rise to a problem in that the slow cooling effect is reduced, i.e., a problem in that the slow cooling effect does not last.

Patent Literature 3 proposes a technique in which longitudinal grooves and a lateral groove are provided on the inner wall surface of a mold, and mold powder is made to flow into the longitudinal grooves and the lateral groove so that the mold can be slowly cooled. However, this technique has a problem in that, in the case where, because of insufficient flow of the mold powder into the grooves, molten steel enters the grooves, and in the case where the mold powder filled in the grooves peels off during casting, and molten steel enters this portion, sticking type breakout may occur.

As described above, either in the technique in which grooves are provided on the inner wall surface of the mold, and air gaps are formed by the grooves or in the technique in which mold powder is made to flow into grooves, it is not possible to obtain a stable slow cooling effect. On the other hand, there have been proposals for methods to provide regular distribution of heat transfer on a solidified shell by filling recessed portions formed on the inner wall surface of a mold with a metal or nonmetal having a thermal conductivity different from that of a mold copper plate. By filling the recessed portions with a metal or a nonmetal, sticking type breakout caused by entry of molten steel into grooves can be prevented.

Patent Literature 4 and Patent Literature 5 propose a technique in which, in order to decrease the amount of uneven solidification by providing regular distribution of heat transfer, grooves (longitudinal grooves or grid grooves) are formed on the inner wall surface of a mold, and the grooves are filled with a low thermal conductivity metal or ceramic. However, this technique has a problem in that stress, which is caused by a difference in thermal strain between copper and the material with which the recessed portions are filled, acts on interfaces between longitudinal grooves or grid grooves and copper (mold) and orthogonal intersections in grid grooves, resulting in occurrence of cracks on the surface of the mold copper plate.

Patent Literature 6 and Patent Literature 7 propose a technique in which, in order to solve the problem in Patent Literature 4 and Patent Literature 5, circular or quasi-circular recessed portions are formed on the inner wall surface of a mold, and the recessed portions are filled with a low thermal conductivity metal or ceramic. In Patent Literature 6 and Patent Literature 7, since the planar shape of the recessed portions is circular or quasi-circular, the interface between the material with which the recessed portions are filled and the mold copper plate is a curved surface, stress is unlikely to concentrate at the interface, and cracks are unlikely to occur on the surface of the mold copper plate, which is advantageous.

Furthermore, Patent Literature 8 proposes techniques in which, in a continuous casting mold having recessed portions that are circular or quasi-circular longitudinal grooves, lateral grooves, or grid grooves, as disclosed in Patent Literature 4, 5, 6, or 7, formed on the inner wall surface of a mold, the recessed portions having dissimilar material-filled layers filled with a material having a thermal conductivity different from that of a mold copper plate, in order to prevent gaps (vacant spaces) from occurring between the material constituting the dissimilar material-filled layers and the mold copper plate, a circular arc-shaped rounded part is provided at a position where the bottom wall of the recessed portion and the side wall of the recessed portion intersect with each other, or the side wall of the recessed portion is tapered such that a cross-sectional shape diminishes in thickness towards the bottom wall. According to Patent Literature 8, it is stated that both in the case where the dissimilar material-filled layers are formed by a plating process and in the case where the dissimilar material-filled layers are formed by a thermal spraying process, the material for filling can be evenly attached and deposited on the recessed portions, and furthermore, not only peel-off of the dissimilar material-filled layers can be prevented, but also heat removal in the mold can be controlled within a desired range.

CITATION LIST

Patent Literature

PTL 1: Japanese Unexamined Patent Application Publication No. 2005-297001

PTL 2: Japanese Unexamined Patent Application Publication No. 1-289542

PTL 3: Japanese Unexamined Patent Application Publication No. 9-276994

PTL 4: Japanese Unexamined Patent Application Publication No. 2-6037

PTL 5: Japanese Unexamined Patent Application Publication No. 7-284896

PTL 6: Japanese Unexamined Patent Application Publication No. 2015-6695

PTL 7: Japanese Unexamined Patent Application Publication No. 2015-51442

PTL 8: Japanese Unexamined Patent Application Publication No. 2014-188521

SUMMARY

Technical Problem

As described above, owing to Patent Literature 6, 7, 8, and the others, the technique of slowly cooling a continuous casting mold has been advanced, and surface cracks in medium carbon steel cast pieces have been reduced.

However, even when the technique of Patent Literature 8 is applied, the life of a continuous casting mold having dissimilar material-filled layers filled with a metal or nonmetal having a thermal conductivity different from that of a mold copper plate on an inner wall surface of the mold is short compared with a continuous casting mold which does not have a dissimilar material-filled layer. A continuous casting mold is expensive, and a small number of usable times leads to an increase in production cost. Several hours are required for operation to replace the continuous casting mold, and a small number of usable times is also a factor in decreasing the continuous casting operation rate.

The disclosed embodiments have been accomplished under these circumstances, and an object of the disclosed embodiments is to provide a continuous casting mold which includes dissimilar material-filled layers filled with a metal or nonmetal having a thermal conductivity different from that of a mold copper plate on an inner wall surface of the mold, in which the number of usable times can be extended compared with the existing number of usable times, and to provide a method for continuously casting steel using the continuous casting mold.

Solution to Problem

The gist of the disclosed embodiments for solving the problems described above is as follows:

[1] A continuous casting mold constituted by a water-cooled copper mold, including recessed portions disposed partially or entirely in a region of an inner wall surface of the water-cooled copper mold from at least a position located at a meniscus to a position located 20 mm lower than the meniscus, and dissimilar material-filled layers formed by filling the corresponding recessed portions with a metal or nonmetal having a thermal conductivity different from that of a mold copper plate constituting the water-cooled copper mold, in which the shape of each of the recessed portions at a surface of the mold copper plate includes a curved surface having a curvature in every direction and a flat surface.

[2] A continuous casting mold constituted by a water-cooled copper mold, including recessed portions disposed partially or entirely in a region of an inner wall surface of the water-cooled copper mold from at least a position located at a meniscus to a position located 20 mm lower than the meniscus, and dissimilar material-filled layers formed by filling the corresponding recessed portions with a metal or nonmetal having a thermal conductivity different from that of a mold copper plate constituting the water-cooled copper mold, in which the shape of each of the recessed portions at a surface of the mold copper plate, at an arbitrary position of the recessed portion, is a curved surface having a curvature in every direction.

[3] The continuous casting mold according to item [1] or [2], in which the recessed portion is formed of a curved surface with a radius of curvature satisfying the formula (1) below:

$$d/2<R\leq d \quad (1)$$

where d is the minimum opening width (mm) of the recessed portion at the inner wall surface of the mold copper plate, and R is the average radius of curvature (mm) of the recessed portion.

[4] The continuous casting mold according to item [3], in which the radius of curvature is a constant value.

[5] The continuous casting mold according to any one of items [1] to [4], in which the opening shape of the recessed portion at the inner wall surface of the mold copper plate is elliptic, and all of the adjacent recessed portions are not in contact with or connected to one another.

[6] The continuous casting mold according to any one of items [1] to [4], in which the opening shape of the recessed portion at the inner wall surface of the mold copper plate is elliptic, and all or some of the adjacent recessed portions are in contact with or connected to one another.

[7] The continuous casting mold according to any one of items [1] to [4], in which the opening shape of the recessed portion at the inner wall surface of the mold copper plate is circular, and all of the adjacent recessed portions are not in contact with or connected to one another.

[8] The continuous casting mold according to any one of items [1] to [4], in which the opening shape of the recessed portion at the inner wall surface of the mold copper plate is circular, and all or some of the adjacent recessed portions are in contact with or connected to one another.

[9] A method for continuously casting steel, the method including using the continuous casting mold according to any one of items [1] to [8], pouring molten steel in a tundish into the continuous casting mold and continuously casting the molten steel.

Advantageous Effects

According to the disclosed embodiments, in a continuous casting mold including dissimilar material-filled layers on an inner wall surface of a water-cooled copper mold, since the shape of a recessed portion forming each dissimilar material-filled layer at the surface of the mold copper plate includes a curved surface having a curvature in every direction and a flat surface or is, at an arbitrary position, a curved surface having a curvature in every direction, it is possible to suppress concentration of stress on the surface of the mold copper plate in contact with the dissimilar material-filled layers. Therefore, occurrence of cracking in the mold copper plate can be suppressed, and the number of usable times of the continuous casting mold including the dissimilar material-filled layers can be extended.

DETAILED DESCRIPTION

Figure 1:
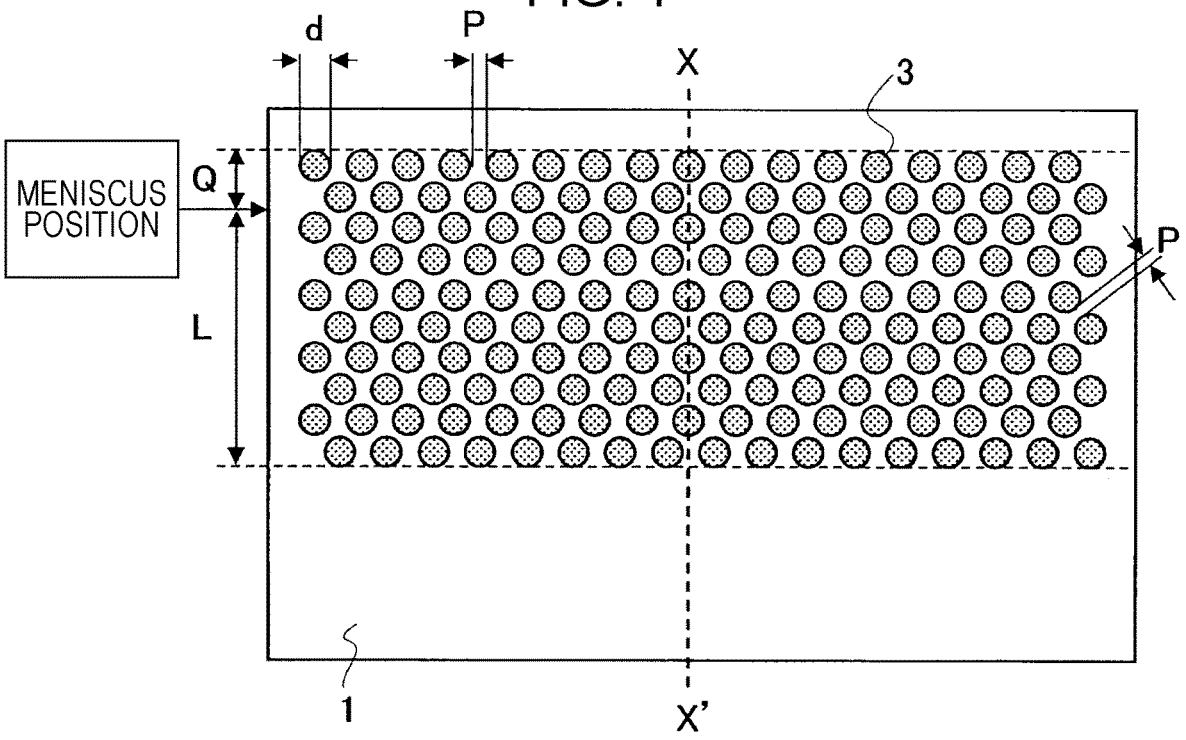
FIG. 1 is a schematic side view of a mold long-side copper plate constituting a part of a continuous casting mold according to an embodiment, from the inner wall surface side, the mold long-side copper plate having dissimilar material-filled layers disposed on the inner wall surface side.
Figure 2:
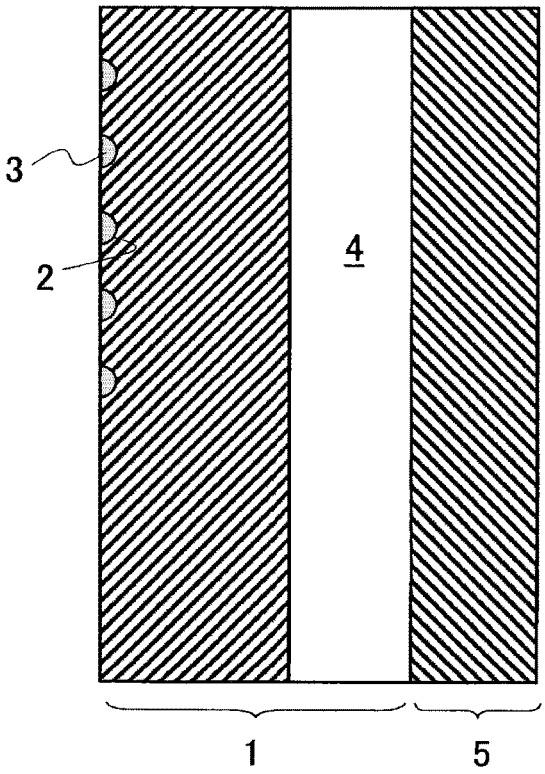
FIG. 2 is a cross-sectional view of the mold long-side copper plate shown in FIG. 1, taken along the line X-X'.

The disclosed embodiments will be specifically described below with reference to the accompanying drawings. FIG. 1 is a schematic side view of a mold long-side copper plate constituting a part of a continuous casting mold according to an embodiment, viewed from the inner wall surface side, the mold long-side copper plate having dissimilar material-filled layers disposed on the inner wall surface side. FIG. 2 is a cross-sectional view of the mold long-side copper plate shown in FIG. 1, taken along the line X-X'.

The continuous casting mold shown in FIG. 1 is an example of a continuous casting mold for casting a cast slab. A continuous casting mold for a cast slab is constituted by joining together a pair of mold long-side copper plates (made of pure copper or a copper alloy) and a pair of mold short-side copper plates (made of pure copper or a copper alloy). FIG. 1 shows a mold long-side copper plate among them. Although dissimilar material-filled layers may be disposed on the inner wall surface side of a mold short-side copper plate as in the mold long-side copper plate, a description of the mold short-side copper plate will be omitted. In some cases, the mold short-side copper plate and the mold long-side copper plate may be simply generically referred to as "mold copper plates". In a cast slab, because of its shape in which the slab width is extremely large relative to the slab thickness, stress concentration is likely to occur in a solidified shell on the long-side surface side of the cast piece, and surface cracks are likely to occur on the long-side surface side of the cast piece. Therefore, dissimilar material-filled layers may not be disposed on the mold short-side copper plate of a continuous casting mold for a cast slab.

As shown in FIG. 1, dissimilar material-filled layers 3 are formed in a region of the inner wall surface of a mold long-side copper plate 1 from a position located higher than the position of a meniscus during steady casting, by a length Q from the meniscus position (the length Q is an arbitrary value equal to or greater than zero) to a position located lower than the meniscus, by a length L from the meniscus (the length L is an arbitrary value equal to or greater than 20 mm). The "steady casting" is a state where, after the start of pouring of molten steel into a continuous casting mold, stationary operation has been achieved while maintaining a constant casting speed. During steady casting, the pouring speed of molten steel from a tundish into a mold is automatically controlled by using a sliding nozzle so that the position of the meniscus can be kept constant. In FIG. 1, d represents the minimum opening width (diameter) of the dissimilar material-filled layer 3 whose opening shape at the inner wall surface of the mold long-side copper plate 1 is circular, and P represents the distance between adjacent dissimilar material-filled layers.

As shown in FIG. 2, the dissimilar material-filled layers 3 are formed by filling recessed portions 2, which are formed on the inner wall surface side of the mold long-side copper plate 1, with a metal or nonmetal having a thermal conductivity different from that of the mold long-side copper plate 1 by a plating process, thermal spraying process, shrink fitting process, or the like. In FIG. 2, reference sign 4 denotes a slit constituting a flow passage of mold cooling water and arranged on the back side of the mold long-side copper plate 1. Reference sign 5 denotes a backplate that adheres closely to the back surface of the mold long-side copper plate 1, and the mold long-side copper plate 1 is cooled by mold cooling water flowing through the slit 4 whose opening side is closed by the backplate 5.

The term "meniscus" refers to the "upper surface of molten steel in a mold". Although its position is not determined when casting is not performed, the meniscus position is controlled to be about 50 mm to 200 mm lower than the upper end of the mold copper plate in an ordinary continuous casting operation for steel. Therefore, even in the case where the meniscus position is 50 mm or 200 mm lower than the upper end of the mold long-side copper plate 1, the dissimilar material-filled layers 3 are arranged so that the length Q and the length L satisfy the conditions according to this embodiment described below.

In consideration of an influence on early stage solidification of a solidified shell, it is necessary that the dissimilar material-filled layers 3 be arranged at least in a region from the meniscus to a position located 20 mm lower than the meniscus. Therefore, it is necessary that the length L be 20 mm or more.

The amount of heat removed through a continuous casting mold is larger in the vicinity of a meniscus position than at other positions. That is, the heat flux in the vicinity of the meniscus position is higher than the heat flux at other positions. The results of experiments conducted by the present inventors show that, although depending on the amount of cooling water fed to the mold and the cast-piece drawing speed, while the heat flux is lower than 1.5 $MW/m^2$ at a position located 30 mm lower than the meniscus, the heat flux is generally 1.5 $MW/m^2$ or more at a position located 20 mm lower than the meniscus.

According to this embodiment, in order to prevent occurrence of surface cracks in a cast piece when high-speed casting is performed or when medium carbon steel is cast in which surface cracks are likely to occur in a cast piece, by forming dissimilar material-filled layers 3, thermal resistance is varied on the inner wall surface of the mold in the vicinity of the meniscus position. By forming the dissimilar material-filled layers 3, a periodic variation in heat flux is sufficiently secured, thereby preventing occurrence of surface cracks in a cast piece. In consideration of the influence on early stage solidification, it is necessary to arrange dissimilar material-filled layers 3 in a region from the meniscus to a position located 20 mm lower than the meniscus in which the heat flux is large. In the case where the length L is less than 20 mm, the effect of preventing surface cracks in a cast piece is insufficient. The upper limit of the length L is not limited, and the dissimilar material-filled layers 3 may be arranged so as to spread up to the lower end of the mold.

On the other hand, the upper end of the dissimilar material-filled layers 3 may be located at any position as long as the position is located at the same position as the meniscus or at a position higher than the meniscus. The length Q shown in FIG. 1 may be any value equal to or greater than zero. However, it is necessary that the meniscus be located within the region where dissimilar material-filled layers 3 are arranged during casting, and the meniscus moves up and down during casting. Therefore, so as to ensure that the upper end of the dissimilar material-filled layers 3 are positioned always higher than the meniscus, it is preferable that the dissimilar material-filled layers 3 be spread and located about 10 mm higher, more preferably about 20 mm to 50 mm higher, than the set-up position of the meniscus.

The thermal conductivity of the metal or nonmetal with which the recessed portions 2 are filled is in general lower than the thermal conductivity of pure copper or a copper alloy constituting the mold long-side copper plate 1. However, in the case where the mold long-side copper plate 1 is made of a copper alloy having a low thermal conductivity, the thermal conductivity of the metal or nonmetal used for filling may be higher. In the case where the material for filling is a metal, filling is achieved by a plating process or thermal spraying process. In the case where the material for filling is a nonmetal, filling is achieved by a thermal spraying process or by fitting a nonmetal, which has been worked to the shape of a recessed portion 2, into the recessed portion 2 (shrink fitting).

Figure 3:
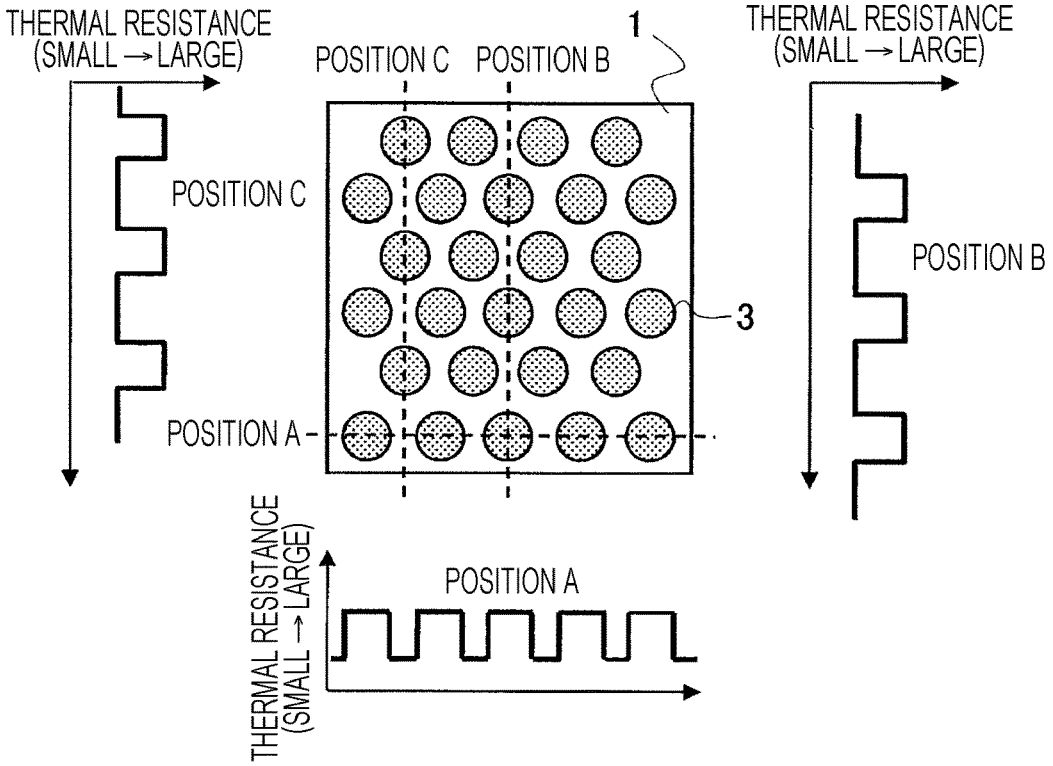
FIG. 3 is a conceptual diagram showing thermal resistances at three positions on a mold long-side copper plate including dissimilar material-filled layers filled with a material having a thermal conductivity lower than that of the mold copper plate, in correspondence to the positions of the dissimilar material-filled layers.

FIG. 3 is a conceptual diagram showing thermal resistances at three positions on a mold long-side copper plate 1 including dissimilar material-filled layers 3 filled with a material having a thermal conductivity lower than that of the mold copper plate, in correspondence to the positions of the dissimilar material-filled layers 3. As shown in FIG. 3, the thermal resistance is relatively high at positions where the dissimilar material-filled layers 3 are arranged.

By arranging dissimilar material-filled layers 3 in the width direction of a continuous casting mold and in the casting direction in the vicinity of a meniscus including the meniscus position, as shown in FIG. 3, the thermal resistance of the continuous casting mold increases and decreases regularly and periodically in the width direction of the mold and in the casting direction in the vicinity of the meniscus. Thereby, in the vicinity of the meniscus, i.e., in the early solidification stage, the heat flux from a solidified shell to the continuous casting mold increases and decreases regularly and periodically. In the case where dissimilar material-filled layers 3 are formed by being filled with a material having a thermal conductivity higher than that of the mold copper plate, unlike FIG. 3, the thermal resistance is relatively low at positions where the dissimilar material-filled layers 3 are arranged. In such a case, in the same manner, the thermal resistance of the continuous casting mold increases and decreases regularly and periodically in the width direction of the mold and in the casting direction in the vicinity of the meniscus.

As a result of the regular and periodic increases and decreases in heat flux, stress caused by transformation from δ iron to γ iron and thermal stress are decreased, and the deformation of the solidified shell caused by these stresses decreases. Because of the decrease in the deformation of the solidified shell, occurrence of depression is suppressed, and uneven distribution of heat flux due to deformation of the solidified shell is uniformized, and the generated stresses are dispersed to decrease individual strains. As a result, occurrence of surface cracks on the surface of the solidified shell is suppressed.

In the disclosed embodiments, pure copper or a copper alloy is used for the mold copper plate. As the copper alloy used for the mold copper plate, a copper alloy to which small amounts of chromium (Cr), zirconium (Zr), and the like are added, which is generally used for a mold copper plate for continuous casting, is used. The thermal conductivity of pure copper is 398 W/(m×K), while the thermal conductivity of a copper alloy is generally lower than that of pure copper, and even a copper alloy whose thermal conductivity is about ½ of that of pure copper is used for a continuous casting mold.

As a material with which the recessed portions 2 are filled, preferably, a material whose thermal conductivity is 80% or less, or 125% or more of the thermal conductivity of the mold copper plate is used. In the case where the thermal conductivity of the material for filling is more than 80%, or less than 125% of that of the mold copper plate, the effect of a periodical variation in heat flux due to the presence of the dissimilar material-filled layers 3 becomes insufficient, and the effect of suppressing surface cracks in a cast piece becomes insufficient when high-speed casting is performed or when medium carbon steel is cast in which surface cracks are likely to occur in a cast piece.

In this embodiment, the material with which the recessed portions 2 are filled is not particularly limited in kind. For reference, examples of a metal that can be suitably used as the material for filling include nickel (Ni, thermal conductivity: 90 W/(m×K)), chromium (Cr, thermal conductivity: 67 W/(m×K)), cobalt (Co, thermal conductivity: 70 W/(m×K)), and alloys containing these metals. These metals and alloys have a lower thermal conductivity than pure copper and copper alloys, and can be easily used for filling the recessed portions 2 by a plating process or thermal spraying process. Examples of a nonmetal that can be suitably used as the material for filling include ceramics, such as BN, AlN, and $ZrO_2$. These materials have a low thermal conductivity and therefore are suitable as the material for filling.

Figure 4:
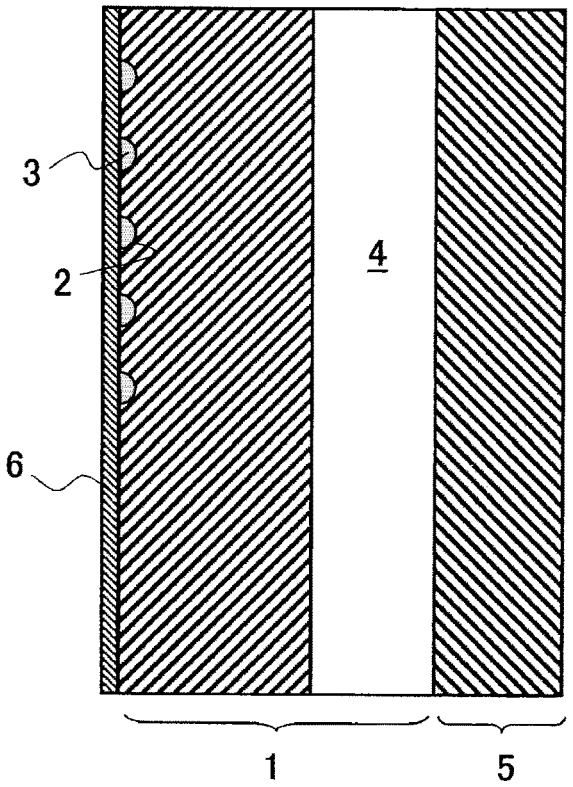
FIG. 4 is a schematic diagram showing an example in which a plating layer for protecting a mold surface is provided on an inner wall surface of a mold long-side copper plate.

FIG. 4 is a schematic diagram showing an example in which a plating layer for protecting a mold surface is provided on an inner wall surface of a mold long-side copper plate. In this embodiment, as shown in FIG. 4, it is preferable to provide a plating layer 6 over an inner wall surface of a mold copper plate having dissimilar material-filled layers 3 thereon for the purpose of preventing abrasion due to a solidified shell and cracks in a mold surface due to thermal hysteresis. The plating layer 6 can be formed by plating nickel or an alloy containing nickel, which is commonly used, for example, a nickel-cobalt alloy (Ni—Co alloy), a nickel-chromium alloy (Ni—Cr alloy), or the like.

Regarding a continuous casting mold including dissimilar material-filled layers 3 in a region where a meniscus is located, which is configured as described above, studies were conducted on extension of mold life. Cracking mainly occurs on the mold copper plate side of an interface where a mold copper plate and a dissimilar material-filled layer 3 are in contact with each other, and the mold life is influenced by the cracking growth rate. Accordingly, studies were conducted on prevention of occurrence of cracking on the mold copper plate side of the interface.

As a result of various studies, considering that, when there is a corner in a recessed portion 2, stress concentrates on the corner, and cracking is likely to occur on the mold copper plate side, it was studied to form the inner surface of a recessed portion 2 into a smooth shape.

Figure 5:
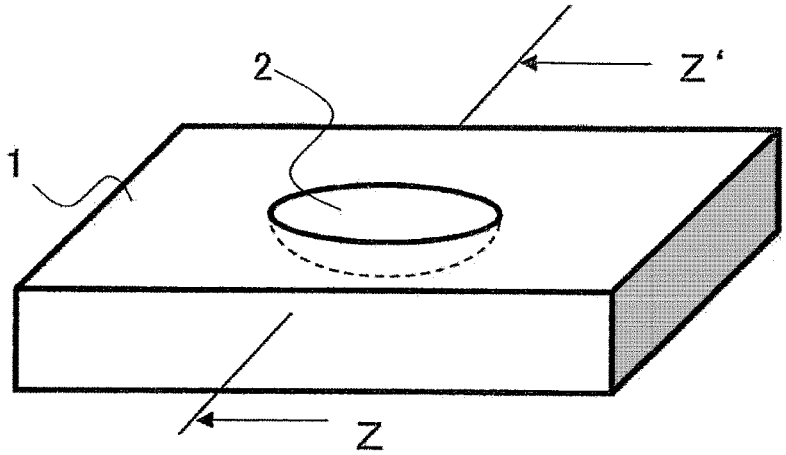
FIG. 5 includes schematic diagrams showing a mold long-side copper plate provided with a recessed portion in which the shape at the surface of the mold copper plate is a curved surface having a curvature in every direction.
Figure 5:
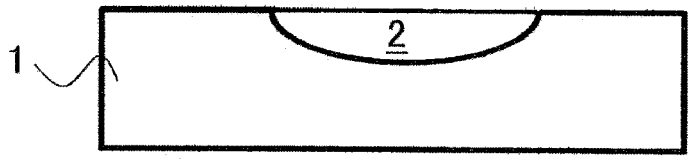
Figure 6:
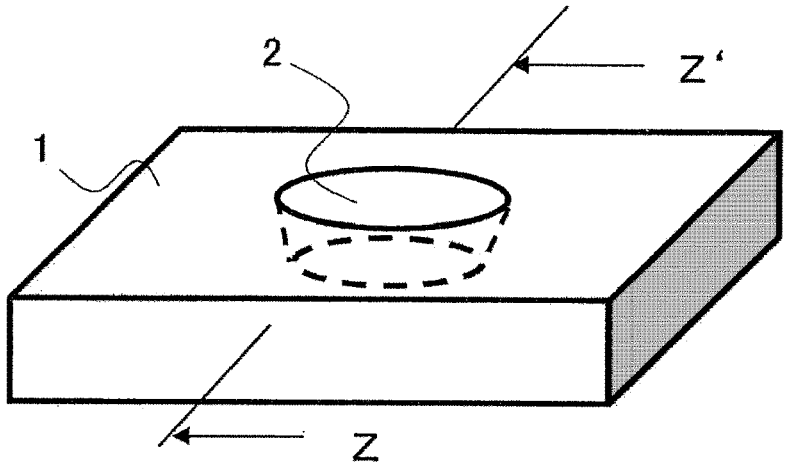
FIG. 6 includes schematic diagrams showing a mold long-side copper plate provided with a recessed portion in which some parts of the shape at the surface of the mold copper plate do not have a curvature.
Figure 6:
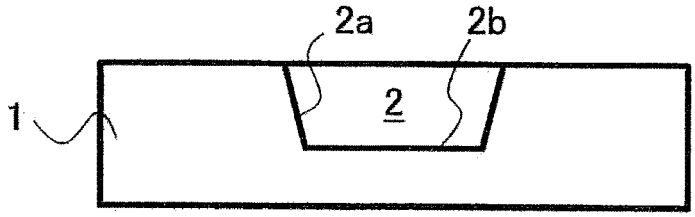

Specifically, as shown in FIG. 5, it was studied to form the shape of a recessed portion 2 at the surface of a mold copper plate into a curved surface having a curvature in every direction, at an arbitrary position of the recessed portion. In contrast to this shape, a shape was formed for comparison, in which, as shown in FIG. 6, a side face 2*a* of a recessed portion 2 is a part of a tapered right circular cone, and a bottom face 2*b* is flat (refer to Patent Literature 8). That is, in the shape for comparison, the shape of the recessed portion 2 at the surface of the mold copper plate partially does not have a curvature. In the recessed portion 2 shown in each of FIGS. 5 and 6, the opening shape of the recessed portion 2 at the inner wall surface of the mold copper plate is circular.

A copper plate test piece provided with a recessed portion 2 having the shape shown in FIG. 5 (thermal conductivity: 360 W/(m×K)) and a copper plate test piece provided with a recessed portion 2 having the shape shown in FIG. 6 (thermal conductivity: 360 W/(m×K)) were prepared. By carrying out a thermal fatigue test (JIS (Japanese Industrial Standards) 2278, higher temperature: 700° C., lower temperature: 25° C.), mold life was evaluated on the basis of the number of thermal cycles at the time of occurrence of cracking on the surface of the copper plate test piece. In the thermal fatigue test, as the number of thermal cycles at the time of occurrence of cracking on the surface of the copper plate test piece is larger, the mold life is evaluated to be longer. In the test, copper plate test pieces provided with a dissimilar material-filled layer 3 formed by filling a recessed portion 2 with pure nickel (thermal conductivity: 90 W/(m×K)) and a copper plate test piece not provided with a dissimilar material-filled layer 3 were used.

FIG. 5 includes schematic diagrams showing a mold long-side copper plate 1 provided with a recessed portion 2 in which the shape at the surface of the mold copper plate is a curved surface having a curvature in every direction. FIG. 5(A) is a perspective view, and FIG. 5(B) is a cross-sectional view of the mold long-side copper plate shown in FIG. 5(A), taken along the line Z-Z'. FIG. 6 includes schematic diagrams showing a mold long-side copper plate 1 provided with a recessed portion 2 in which some parts of the shape at the surface of the mold copper plate do not have a curvature. FIG. 6(A) is a perspective view, and FIG. 6(B) is a cross-sectional view of the mold long-side copper plate shown in FIG. 6(A), taken along the line Z-Z'. In the recessed portion 2 shown in FIG. 6, not only the bottom face 2*b* is flat, but also the side face 2*a* does not have a curvature in the depth direction of the recessed portion 2.

Figure 7:
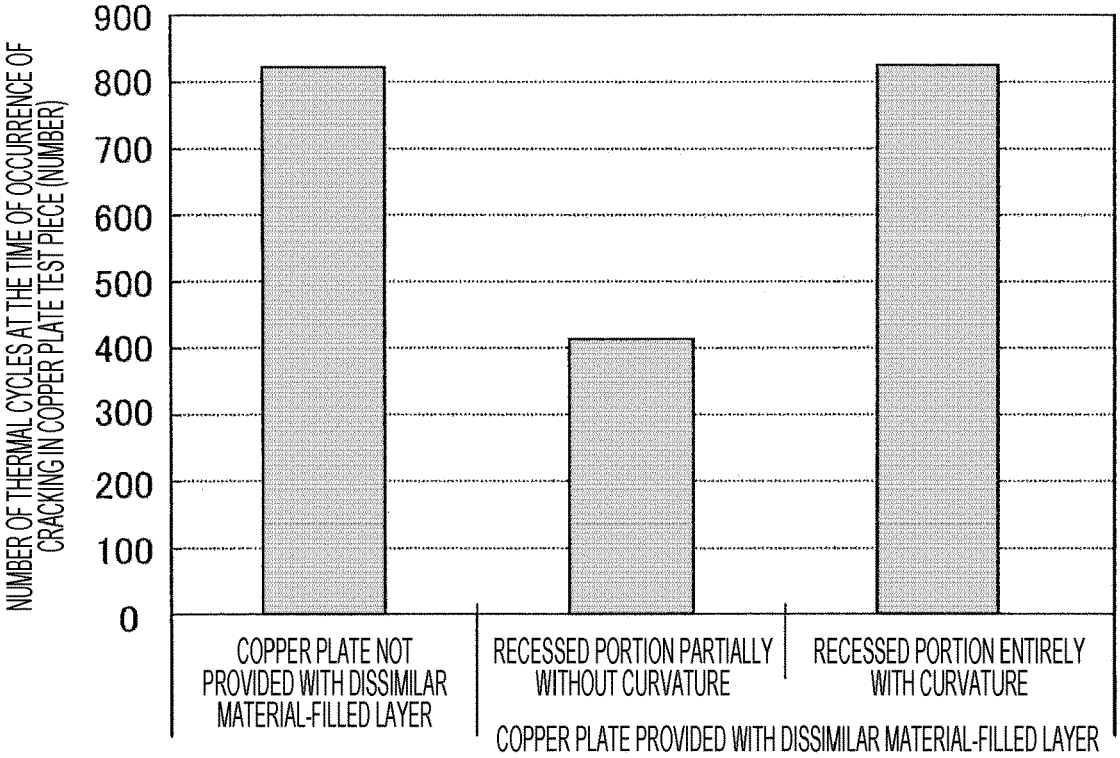
FIG. 7 is a graph showing the results of a thermal fatigue test.

FIG. 7 is a graph showing the results of the thermal fatigue test. As shown in FIG. 7, it was confirmed that, in the case where the shape of the recessed portion 2 at the surface of the mold copper plate is a curved surface having a curvature in every direction, the number of thermal cycles at the time of occurrence of cracking is equal to that of the copper plate test piece not provided with a dissimilar material-filled layer 3, and the mold life is equal to that of the copper plate test piece not provided with a dissimilar material-filled layer 3. In contrast, it is evident that, in the case where some parts of the shape of the recessed portion 2 at the surface of the mold copper plate do not have a curvature, the mold life is about ½ of that of the copper plate test piece not provided with a dissimilar material-filled layer 3. In the case where a recessed portion 2 has a shape, at the surface of a mold copper plate, in which only the intersection of a bottom face with a side face is rounded, because of no variation in the shape of a vertical portion, the life was improved only by about ⅝. From these results, it is evident that by forming the interface between the dissimilar material-filled layer 3 and the mold copper plate to be a curved surface having a curvature in every direction, excellent resistance to occurrence of cracking is obtained, and the mold life is improved.

Furthermore, the diameter of a dissimilar material-filled layer 3 at the copper plate wall surface, i.e., the minimum opening width of a recessed portion 2 formed of a curved surface having a curvature in every direction, was set to two levels: 5 mm and 6 mm, and copper plate test pieces (thermal conductivity: 360 W/(m×K)) having a recessed portion 2, which were different in the average radius of curvature constituting the recessed portion 2, were prepared. By carrying out the thermal fatigue test (JIS 2278, higher temperature: 700° C., lower temperature: 25° C.), the influence of the average radius of curvature of the recessed portion 2 on the number of thermal cycles at the time of occurrence of cracking on the surfaces of the copper plate test pieces was investigated. The opening shape of the recessed portion 2 at the copper plate wall surface was circular in all the test pieces. In the test, the dissimilar material-filled layer 3 was formed by filling the recessed portion 2 with pure nickel (conductivity: 90 W/(m×K)). The curvatures of the curved surface of the recessed portion 2 were measured by a CNC 3D measuring instrument and stored as digital data, and on the basis of this, the radii of curvature in the horizontal direction and in the vertical direction at each measuring point were obtained. The average radius of curvature was calculated by dividing the sum total of the measured radii of curvature by the measured number of radii of curvature. The average radius of curvature was calculated by excluding data with an infinite radius of curvature.

Figure 8:
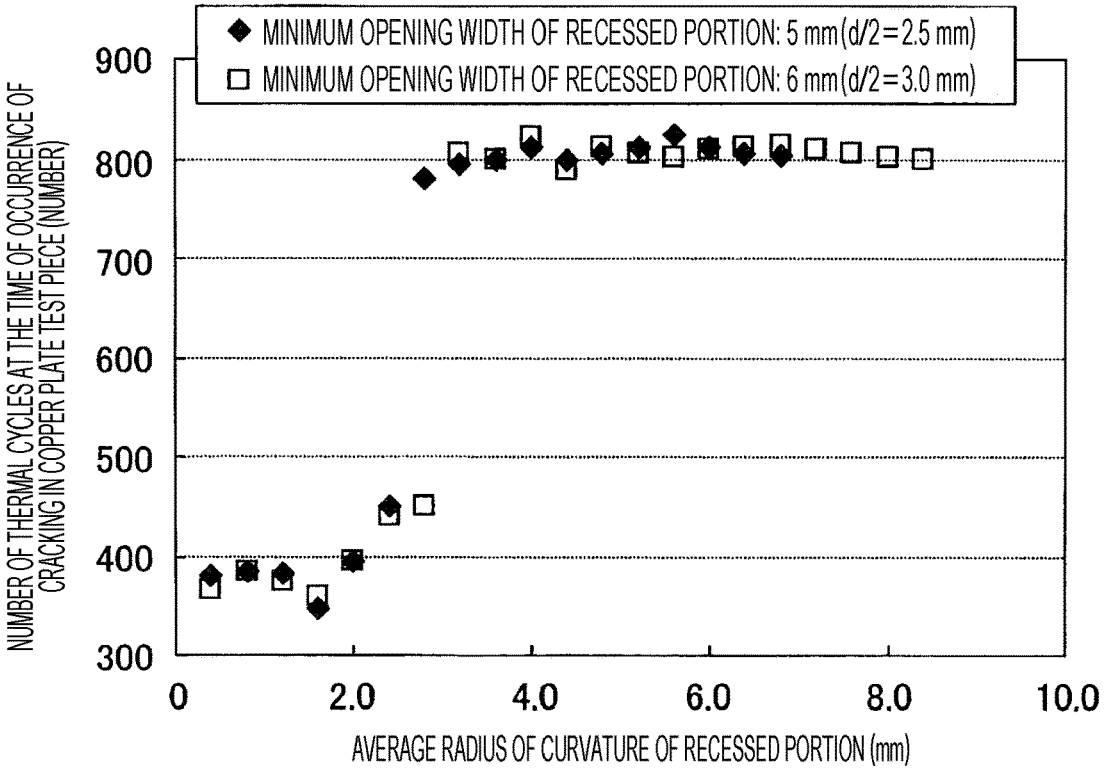
FIG. 8 is a graph showing the influence of the average radius of curvature of the recessed portion on the number of thermal cycles at the time of occurrence of cracking in the copper plate test piece.

FIG. 8 is a graph showing the influence of the average radius of curvature of the recessed portion on the number of thermal cycles at the time of occurrence of cracking in the copper plate test piece. As shown in FIG. 8, it was confirmed that, in the case where the average radius of curvature constituting the recessed portion 2 is more than ½ of the minimum opening width d of the recessed portion 2, the number of thermal cycles at the time of occurrence of cracking on the surface of the copper plate test piece is large, and the mold life is further extended. It is considered that, in the case where the average radius of curvature constituting the recessed portion 2 is ½ or less of the minimum opening width d of the recessed portion 2, stress at the interface between the dissimilar material-filled layer 3 and the mold copper plate increases, and cracking is likely to occur.

On the basis of the results described above, a test was further carried out by using an actual continuous casting machine for slab. In the actual machine test, mainly, the occurrence state of surface defects in cast slab was checked. In the actual machine test, three levels were tested: a continuous casting mold having a mold long-side copper plate 1 provided with a recessed portion 2 shown in FIG. 5, a continuous casting mold having a mold long-side copper plate 1 provided with a recessed portion 2 shown in FIG. 6, and a continuous casting mold having a mold long-side copper plate not provided with a dissimilar material-filled layer 3. In the test, a copper alloy having a thermal conductivity of 360 W/(m×K) was used as the mold long-side copper plate 1, and pure nickel having a thermal conductivity of 90 W/(m×K) was used as the material with which the recessed portion 2 was filled. The length Q was set at 50 mm, and the length L was set at 200 mm.

Figure 9:
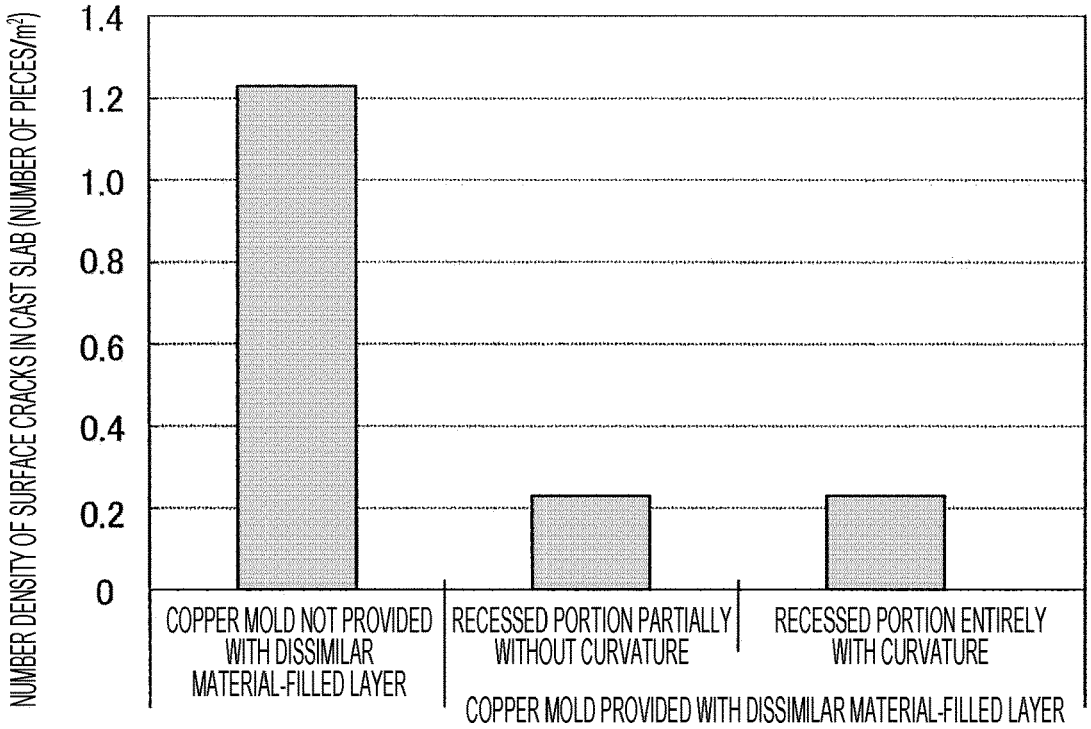
FIG. 9 is a graph showing investigation results of the number density of surface cracks in cast slab.

FIG. 9 is a graph showing investigation results of the number density of surface cracks in cast slab. As shown in FIG. 9, it was confirmed that, even when the shape of the recessed portion 2 at the surface of the mold copper plate is a curved surface having a curvature in every direction as shown in FIG. 5 or a shape in which the recessed portion 2 is partially without a curvature as shown in FIG. 6, as long as the copper mold is provided with the dissimilar material-filled layer 3, the number density of surface cracks in cast slab is greatly decreased compared with the case where the copper mold not provided with a dissimilar material-filled layer 3 is used. From the results, it is evident that by providing the dissimilar material-filled layer 3, surface cracks in cast slab can be effectively reduced.

Furthermore, regarding a mold long-side copper plate 1 having a recessed portion 2 in which the opening shape of the recessed portion 2 at the inner wall surface of the copper plate is circular and the shape of the recessed portion 2 at the surface of the mold copper plate is a curved surface having a curvature in every direction, the diameter of a dissimilar material-filled layer 3 at the copper plate inner wall surface, i.e., the minimum opening width of the recessed portion 2, was set to two levels: 5 mm and 6 mm, and the average radius of curvature constituting the recessed portion 2 was varied. The influence of the average radius of curvature of the recessed portion 2 on the number density of surface cracks in cast slab was investigated. In the test, a copper alloy having a thermal conductivity of 360 W/(m×K) was used as the mold long-side copper plate 1, and pure nickel having a thermal conductivity of 90 W/(m×K) was used as the material with which the recessed portion 2 was filled. The length Q was set at 50 mm, and the length L was set at 200 mm.

Figure 10:
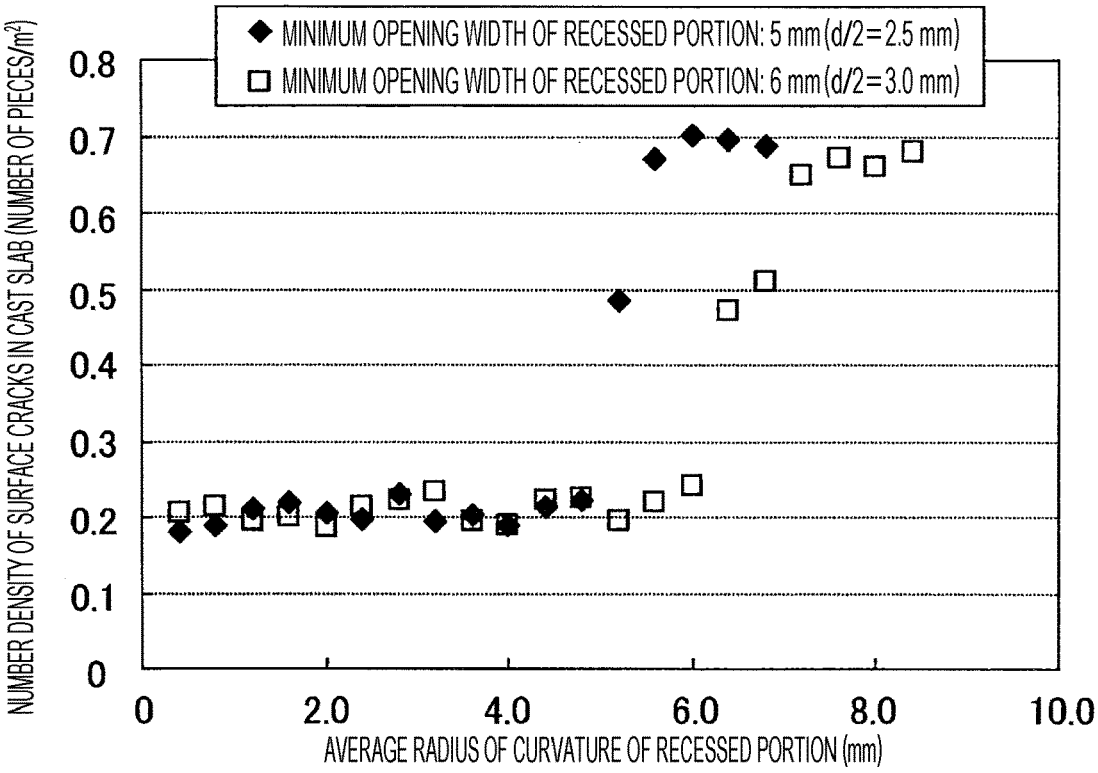
FIG. 10 is a graph showing the influence of the average radius of curvature of the recessed portion on the number density of surface cracks in cast slab.

FIG. 10 is a graph showing the influence of the average radius of curvature of the recessed portion on the number density of surface cracks in cast slab. As shown in FIG. 10, it was confirmed that, in the case where the average radius of curvature constituting the recessed portion 2 is equal to or less than the minimum opening width d of the recessed portion 2, the number density of surface cracks in cast slab is further decreased. It is considered that, in the case where the average radius of curvature constituting the recessed portion 2 is more than the minimum opening width d of the recessed portion 2, the volume of the dissimilar material-filled layer 3 disposed in the recessed portion 2 is decreased, and the effect of suppressing surface cracks in cast slab is decreased.

On the basis of the test results described above, in this embodiment, it is necessary that the shape of the recessed portion 2 at the surface of the mold copper plate, at an arbitrary position of the recessed portion 2, be a curved surface having a curvature in every direction. Here, the term "curved surface having a curvature in every direction" refers to a curved surface, such as a spherical crown surface that is a part of a spherical surface, or a part of an ellipsoid. In such a case, preferably, the average radius of curvature constituting the recessed portion 2 satisfies the formula (1) below.

$$d/2<R\leq d \quad (1)$$

In the formula (1), d is the minimum opening width (mm) of the recessed portion at the inner wall surface of the mold copper plate, and R is the average radius of curvature (mm) of the recessed portion.

The reason for this is considered to be that, as described above, in the case where the average radius of curvature constituting the recessed portion 2 is ½ or less of the minimum opening width d of the recessed portion 2, stress at the interface between the dissimilar material-filled layer 3 and the mold copper plate increases, and cracking is likely to occur. On the other hand, it is considered that, in the case where the average radius of curvature constituting the recessed portion 2 is more than the minimum opening width d of the recessed portion 2, the volume of the dissimilar material-filled layer 3 is decreased, and the effect of suppressing surface cracks in cast slab is decreased.

In this embodiment, when the radii of curvature constituting the recessed portion 2 are constant, designing and processing for the recessed portion 2 are facilitated, which is preferable, however, as long as the curved surface has a curvature in every direction, the radii of curvature may not be constant.

Although FIGS. 1 and 2 show an example in which the shape of the dissimilar material-filled layer 3 at the inner wall surface of the mold long-side copper plate 1 is circular, the shape is not necessarily circular. Any kind of shape may be used as long as the shape is one close to a circle, such as an ellipse that does not have a so-called "angle". Hereinafter, a shape close to a circle will be referred to as a "quasi-circle". Examples of the quasi-circle include shapes having no corners, such as an ellipse and a rectangle having circular or elliptic corners.

The minimum opening width d in the formula (1) is defined by the length of the shortest straight line among the straight lines that pass through the center of an opening shape of the recessed portion 2 at the inner wall surface of the mold long-side copper plate 1, i.e., defined by the length of the shortest straight line among the straight lines that pass through the center of a shape of the dissimilar material-filled layer 3 at the inner wall surface of the mold long-side copper plate 1. Accordingly, the minimum opening width d corresponds to the diameter of a circle when the opening shape of the recessed portion 2 at the inner wall surface of the mold long-side copper plate 1 is circular, and corresponds to the minor axis of an ellipse when the opening shape is elliptic. In the case where the opening shape of the recessed portion 2 at the inner wall surface of the mold long-side copper plate 1 is circular and the average radius of curvature R constituting the recessed portion 2 satisfies the formula (1), a recessed portion 2 can be formed with a constant radius of curvature of the recessed portion 2.

The diameter (equivalent circle diameter in the case of a quasi-circle) of the dissimilar material-filled layer 3 is preferably 2 to 20 mm. By setting the diameter of the dissimilar material-filled layer 3 to be 2 mm or more, the decrease in the heat flux in the dissimilar material-filled layer 3 becomes sufficient, and an effect of suppressing surface cracks can be obtained. By setting the diameter of the dissimilar material-filled layer 3 to be 2 mm or more, the recessed portion 2 can be easily filled with a metal by a plating process or thermal spraying process. On the other hand, by setting the diameter (equivalent circle diameter in the case of a quasi-circle) of the dissimilar material-filled layer 3 to be 20 mm or less, delay in solidification at the dissimilar material-filled layer 3 is suppressed, stress concentration locally on the solidified shell is prevented, and it is possible to suppress occurrence of surface cracks in the solidified shell. The equivalent circle diameter is calculated, assuming that the quasi-circle is a circle, from an area of a quasi-circular dissimilar material-filled layer 3.

Figure 11:
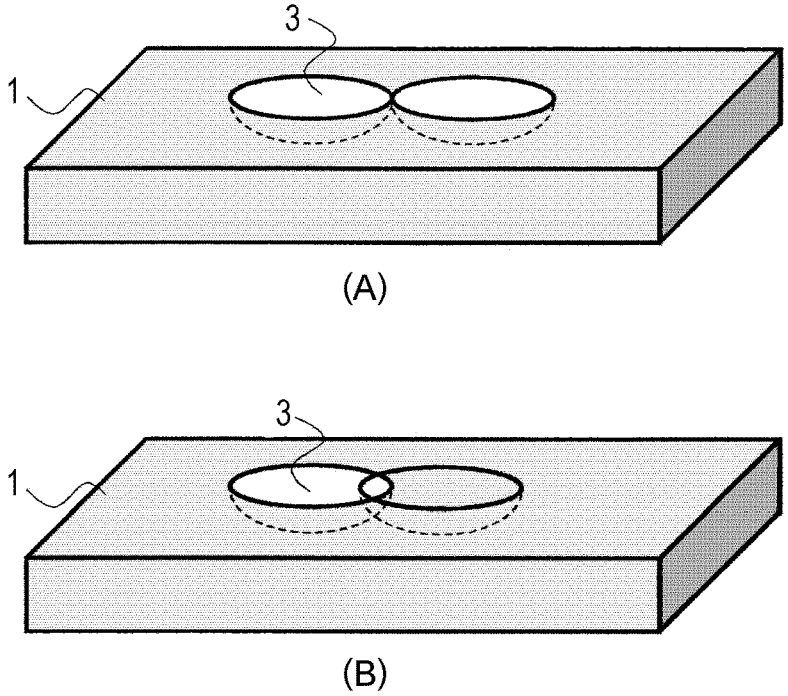
FIG. 11 includes schematic diagrams showing arrangement examples of dissimilar material-filled layers.

FIGS. 1 and 2 show an example in which dissimilar material-filled layers 3 are arranged so as to be separated from one another by a distance P. However, the dissimilar material-filled layers 3 are not necessarily separated from one another. For example, as shown in FIG. 11, dissimilar material-filled layers may be in contact with or connected to one another. FIG. 11 includes schematic diagrams showing arrangement examples of dissimilar material-filled layers 3, (A) showing an example in which dissimilar material-filled layers are in contact with each other, (B) showing an example in which dissimilar material-filled layers are connected to each other.

By configuring dissimilar material-filled layers 3 to a shape as shown in FIG. 11(A) or 11(B), the dissimilar material-filled layers have an overlapping region one another and it is possible to maintain, for a long time, a state in which the heat flux varies in the mold width direction or in the cast-piece drawing direction. Therefore, the period of the heat flux variation can be set such that a long period and a short period are superposed on each other. That is, it becomes possible to control the heat flux distribution (the maximum value and minimum value of heat flux) in the mold width direction or in the cast-piece drawing direction, and the stress dispersion effect during the $\delta\rightarrow\gamma$ transformation or the like can be enhanced. Further, since the interface between the dissimilar material-filled layer 3 and the mold copper plate is decreased, stress on the dissimilar material-filled layer is decreased during use, and the mold life is improved.

Preferably, the area ratio ε ($\varepsilon=(B/A)\times100$), which is a ratio of the total sum B ($mm^2$) of areas of all the dissimilar material-filled layers 3 to the area A ($mm^2$) of the inner wall surface of the mold copper plate in a region where the dissimilar material-filled layers 3 are disposed, is 10% or more. By securing an area ratio ε of 10% or more, the area occupied by the dissimilar material-filled layers 3 with low heat flux is secured, and a difference in heat flux between the dissimilar material-filled layer 3 and the pure copper portion or copper alloy portion can be obtained. Thus, the effect of suppressing surface cracks in a cast piece can be stably obtained. Although the upper limit of the area ratio ε may not be necessarily specified, when the area ratio ε is 50% or more, the effect of suppressing surface cracks in a cast piece due to the periodic difference in heat flux is saturated. Therefore, an upper limit of 50% is sufficient.

FIG. 5 shows a recessed portion 2 formed of a curved surface having a curvature in every direction, at an arbitrary position. However, the shape of the recessed portion 2 may include a curved surface having a curvature in every direction and a flat surface.

Regarding continuous casting of a cast piece by using a continuous casting mold configured as described above, the mold is suitably used for, in particular, continuous casting of a cast slab (thickness: 200 mm or more) of medium carbon steel having a carbon content of 0.08 to 0.17% by mass, which is highly susceptible to surface cracks. Hitherto, in the case where a cast slab of medium carbon steel is continuously cast, in order to prevent surface cracks in the cast piece, the cast-piece drawing speed has been generally decreased. By using the continuous casting mold according to this embodiment, surface cracks in a cast piece can be suppressed. Therefore, even at a cast-piece drawing speed of 1.5 m/min or more, a cast piece free from surface cracks or with a very small number of surface cracks can be continuously cast.

As described above, in a continuous casting mold including dissimilar material-filled layers 3 on an inner wall surface of a water-cooled copper mold, since the shape of a recessed portion 2 forming each dissimilar material-filled layer 3 at the surface of the mold copper plate is, at an arbitrary position of the recessed portion, a curved surface having a curvature in every direction, concentration of stress does not occur on the surface of the mold copper plate in contact with the dissimilar material-filled layer 3. Therefore, occurrence of cracking in the mold copper plate can be suppressed, and the number of usable times of the continuous casting mold including the dissimilar material-filled layers 3 can be greatly extended.

The above description has been given on continuous casting of a cast slab. However, this embodiment is not limited to continuous casting of a cast slab, but can also be applied to continuous casting of a cast bloom or cast billet.

Examples 300 tons of medium carbon steel (chemical composition, C: 0.08 to 0.17% by mass, Si: 0.10 to 0.30% by mass, Mn: 0.50 to 1.20% by mass, P: 0.010 to 0.030% by mass, S: 0.005 to 0.015% by mass, and Al: 0.020 to 0.040% by mass) was continuously cast using water-cooled molds made of a copper alloy in which dissimilar material-filled layers were formed on inner wall surfaces thereof under various conditions. Tests were carried out to check the number of surface cracks in cast slabs after casting and the number of occurrences of cracking on the surfaces of the mold copper plates (Examples and Comparative Examples). The water-cooled molds made of a copper alloy used had an inner space in which the length of the long side was 1.8 m and the length of the short side was 0.22 m. For comparison, tests were also carried out on a water-cooled mold made of a copper alloy in which dissimilar material-filled layers were not formed (Conventional Example).

In each of the water-cooled molds made of a copper alloy, the length from the upper end to the lower end of the mold was 950 mm, the position of a meniscus (upper surface of molten steel in the mold) during steady casting was set to be 100 mm lower than the upper end of the mold, and dissimilar material-filled layers were disposed in a region from a position 60 mm lower than the upper end of the mold to a position 400 mm lower than the upper end of the mold.

A copper alloy having a thermal conductivity of 360 W/(m×K) was used as the mold copper plates, and pure nickel (thermal conductivity: 90 W/(m×K)) was used as the filler material for the dissimilar material-filled layers. The opening shape of each recessed portion at the inner wall surface of the mold long-side copper plate was set to be circular or elliptic. Recessed portions formed with various average radii of curvature were filled with pure nickel by a plating process to form dissimilar material-filled layers. Table 1 shows the minimum opening width d of the recessed portion, the average radius of curvature R, and the shape of the filled portion. In Examples 19 and 20, the opening shape of each recessed portion is circular, and the shape of the filled portion is spherical crown-shaped with a flat surface bottom.

TABLE 1

| | Minimum opening width d (mm) | ½ × Minimum opening width d/2 (mm) | Average radius of curvature R (mm) | Shape of filled portion | Number density of surface cracks in cast piece (number/m$^2$) | Number index of cracking on the surface of mold copper plate (—) |
|---|---|---|---|---|---|---|
| Conventional Example | — | — | — | — | 1.23 | 1.00 |
| Example 1 | 5.0 | 2.5 | 3.0 | Spherical crown-shaped | 0.21 | 0.90 |
| Example 2 | 6.0 | 3.0 | 3.1 | Spherical crown-shaped | 0.19 | 1.10 |
| Example 3 | 6.0 | 3.0 | 4.0 | Spherical crown-shaped | 0.18 | 1.20 |
| Example 4 | 7.0 | 3.5 | 5.0 | Spherical crown-shaped | 0.22 | 0.80 |
| Example 5 | 8.0 | 4.0 | 6.0 | Spherical crown-shaped | 0.23 | 0.90 |
| Example 6 | 10.0 | 5.0 | 5.5 | Spherical crown-shaped | 0.20 | 1.00 |
| Example 7 | 6.0 | 3.0 | 3.2 | Spherical crown-shaped | 0.21 | 1.00 |
| Example 8 | 12.0 | 6.0 | 6.2 | Spherical crown-shaped | 0.18 | 1.10 |
| Example 9 | 4.0 | 2.0 | 2.5 | Spherical crown-shaped | 0.22 | 1.20 |
| Example 10 | 6.0 | 3.0 | 3.5 | Spherical crown-shaped | 0.21 | 1.00 |
| Example 11 | 3.0 | 1.5 | 2.0 | Spherical crown-shaped | 0.23 | 0.90 |
| Example 12 | 6.0 | 3.0 | 2.5 | Spherical crown-shaped | 0.23 | 1.00 |
| Example 13 | 6.0 | 3.0 | 6.5 | Spherical crown-shaped | 0.65 | 0.95 |
| Example 14 | 5.0 | 2.5 | 2.0 | Spherical crown-shaped | 0.23 | 0.91 |
| Example 15 | 10.0 | 5.0 | 3.0 | Spherical crown-shaped | 0.24 | 1.02 |
| Example 16 | 7.0 | 3.5 | 8.1 | Spherical crown-shaped | 0.45 | 0.93 |
| Example 17 | 8.0 | 4.0 | 9.0 | Spherical crown-shaped | 0.46 | 0.99 |
| Example 18 | 4.0 | 2.0 | 1.9 | Spherical crown-shaped | 0.20 | 1.02 |
| Example 19 | 12.0 | 6.0 | 6.2 | Spherical zone-shaped with a flat surface bottom having a diameter of 6 mm | 0.19 | 1.12 |
| Example 20 | 5.0 | 2.5 | 2.0 | Spherical zone-shaped with a flat surface bottom having a diameter of 2 mm | 0.24 | 0.94 |
| Comparative Example 1 | 5.0 | 2.5 | — | Cylindrical | 0.78 | 1.23 |
| Comparative Example 2 | 6.0 | 3.0 | — | Quadrangular prismatic | 0.82 | 1.32 |

TABLE 1-continued

| | Minimum opening width d (mm) | ½ × Minimum opening width d/2 (mm) | Average radius of curvature R (mm) | Shape of filled portion | Number density of surface cracks in cast piece (number/m$^2$) | Number index of cracking on the surface of mold copper plate (—) |
|---|---|---|---|---|---|---|
| Comparative Example 3 | 8.0 | 4.0 | — | Triangular prismatic | 0.79 | 1.35 |
| Comparative Example 4 | 4.0 | 2.0 | — | Cylindrical | 0.76 | 1.42 |
| Comparative Example 5 | 7.6 | 3.8 | — | Cylindrical | 0.83 | 1.32 |

After completion of continuous casting, an area of 21 m$^2$ or more on the surface of a cast slab after casting was checked by a dye penetrant test, the number of surface cracks with a length of 1.0 mm or more was measured, and by dividing the total sum thereof by the measured area of the cast piece, a number density of surfaces cracks in the cast piece was obtained. By using the number density, the occurrence state of surface cracks in the cast piece was evaluated. After completion of continuous casting, the number of cracks on the surface of the mold copper plate was measured to evaluate the mold life. Table 1 also shows the investigation results of the number density of surface cracks in cast slab and the number index of cracking on the surface of the mold copper plate. The number index of cracking on the surface of the mold copper plate was calculated by dividing the measured number of cracks by the number of cracks measured in Conventional Example.

Figure 12:
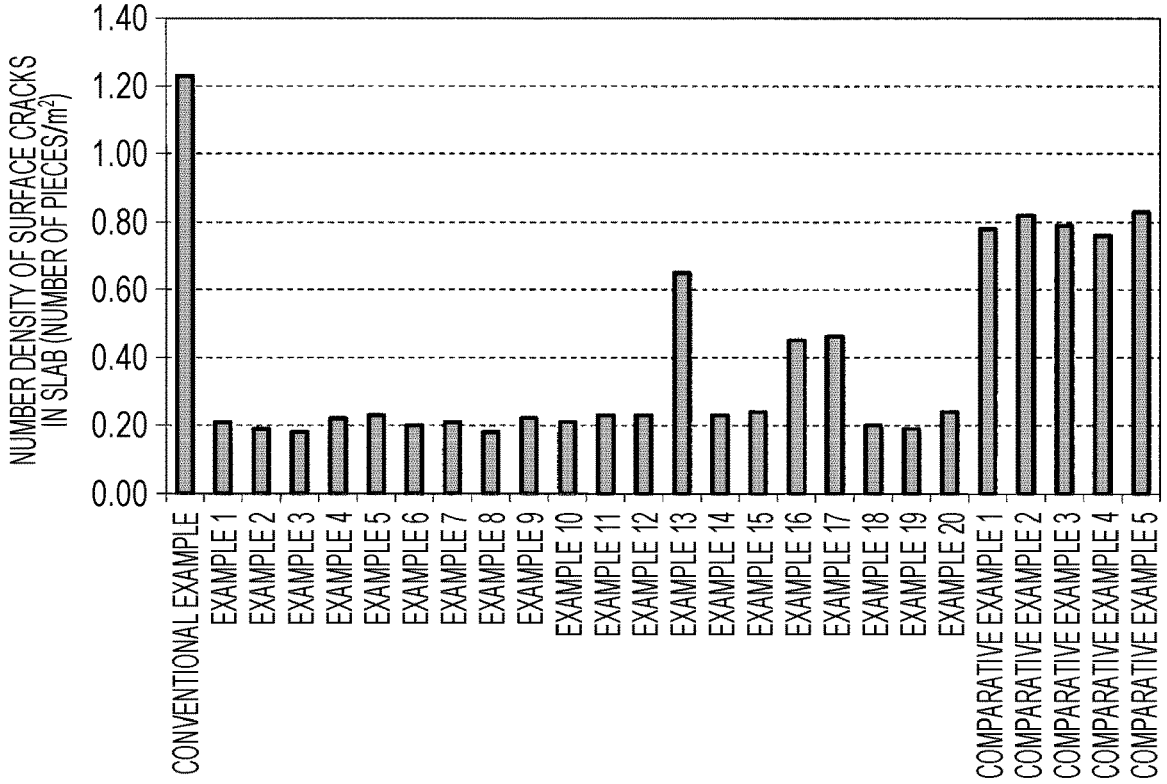
FIG. 12 is a graph showing the number density of surface cracks in cast slab in Examples 1 to 20, Comparative Examples 1 to 5, and Conventional Example.

FIG. 12 is a graph showing the number density of surface cracks in cast slab in Examples 1 to 20, Comparative Examples 1 to 5, and Conventional Example. As shown in FIG. 12, it is evident that in Examples, the number density of surface cracks in the cast piece can be reduced compared with Comparative Examples and Conventional Example. It is evident that in the case where the average radius of curvature R of the recessed portion is equal to or less than the minimum opening width d, the number of surface cracks in the cast piece is stably decreased. From the results of Examples 19 and 20, it is evident that even when the shape of the filled portion is spherical crown-shaped with a flat surface bottom, the number of surface cracks in the cast piece can be decreased compared with Comparative Examples and Conventional Example.

Figure 13:
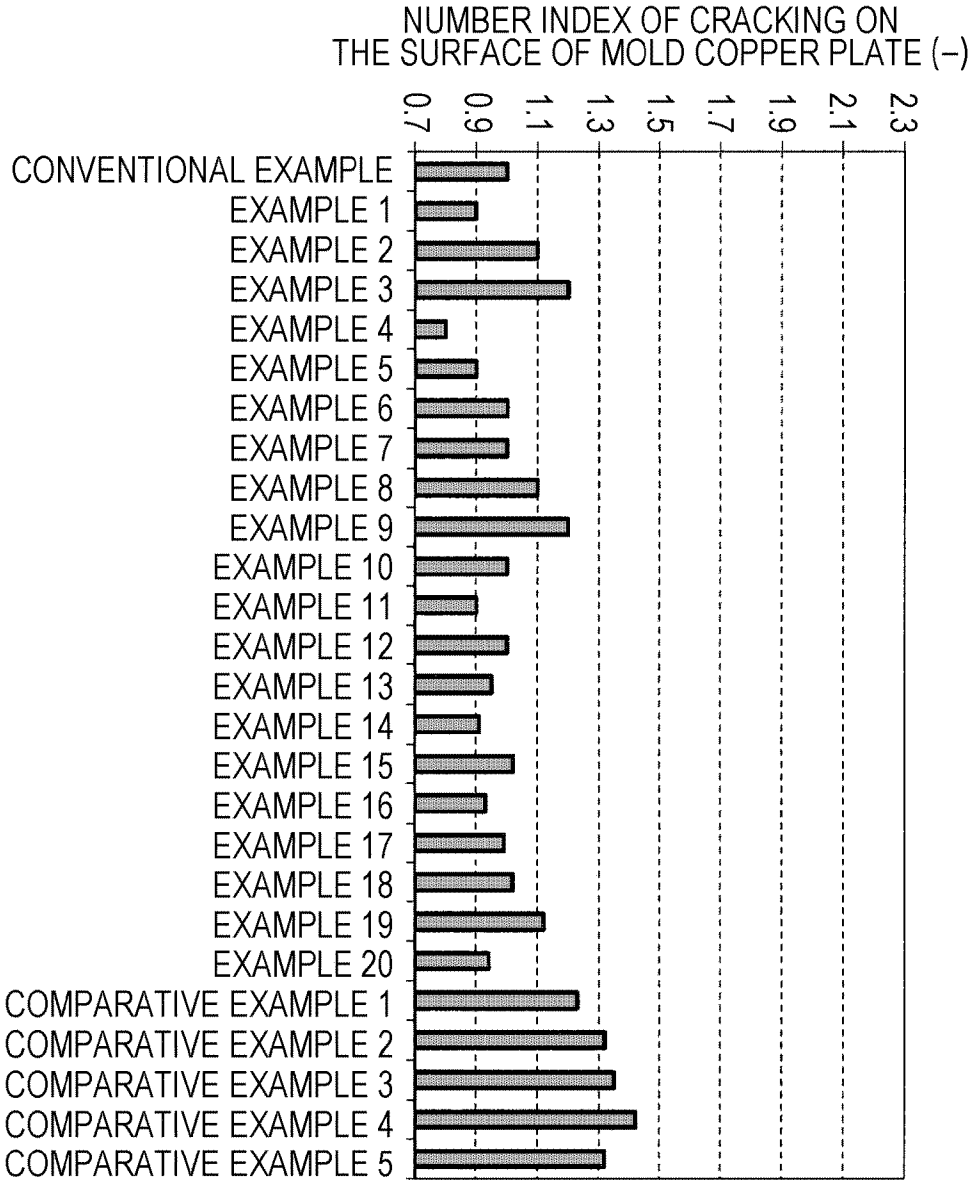
FIG. 13 is a graph showing the number index of cracking on the surface of the mold copper plate in Examples 1 to 20, Comparative Examples 1 to 5, and Conventional Example.

FIG. 13 is a graph showing the number index of cracking on the surface of the mold copper plate in Examples 1 to 20, Comparative Examples 1 to 5, and Conventional Example. As shown in FIG. 13, it is evident that in Examples, the number index of cracking on the surface of the mold copper plate is small compared with Comparative Examples, and occurrence of cracking on the surface of the mold copper plate can be reduced. From the results of Examples 19 and 20, it is evident that even when the shape of the filled portion is spherical crown-shaped with a flat surface bottom, the number index of cracking is small compared with Comparative Examples and Conventional Example, and occurrence of cracking on the surface of the mold copper plate can be reduced.

On the other hand, among Examples, in the case where the average radius of curvature R of the recessed portion is more than ½ of the minimum opening width d of the recessed portion and in the case where the average radius of curvature R of the recessed portion is ½ or less of the minimum opening width d of the recessed portion, as shown in FIG. 8, in the case where the average radius of curvature R of the recessed portion is more than ½ of the minimum opening width d of the recessed portion, the number of thermal cycles at the time of occurrence of cracking is greatly increased compared with the case where the average radius of curvature R of the recessed portion is ½ or less of the minimum opening width d of the recessed portion, and by setting the average radius of curvature R of the recessed portion to be more than ½ of the minimum opening width d of the recessed portion, it is possible to suppress occurrence of cracking on the surface of the mold copper plate.

In Table 1, although there is a slight variation, the number index of cracking on the surface of the mold copper plate differs depending on the magnitude relationship between the average radius of curvature R of the recessed portion and ½ of the minimum opening width d of the recessed portion. In Table 1, in the case where the average radius of curvature R of the recessed portion is ½ or less of the minimum opening width d of the recessed portion, in 3 out of 4 examples, the number index of cracking is equal to or more than that of Conventional Example, while in the case where the average radius of curvature R of the recessed portion is more than ½ of the minimum opening width d of the recessed portion, in 7 out of 14 examples, the number index of cracking is equal to or more than that of Conventional Example. Thus, it is evident that, by setting the average radius of curvature R of the recessed portion to be more than ½ of the minimum opening width d of the recessed portion, it is possible to further reduce the occurrence of cracking on the surface of the mold copper plate. As is evident from these results and the results of FIG. 12, in order to suppress surface cracks in cast slab and to extend the mold life, it is effective to set the average radius of curvature R constituting the recessed portion to be in the range of the formula (1).

The invention claimed is:

1. A continuous casting mold comprising:

a water-cooled copper mold having a mold copper plate including an inner wall surface;

recessed portions disposed partially or entirely in a region of the inner wall surface of the water-cooled copper mold from at least a position located at a meniscus to a position located 20 mm lower than the meniscus; and material-filled layers disposed in the recessed portions with a metal or nonmetal having a thermal conductivity different from that of the mold copper plate of the water-cooled copper mold, wherein a shape of each of the recessed portions at a surface of the mold copper plate includes a curved surface having a curvature in every direction and a flat surface, and the curved surface has a radius of curvature satisfying the formula (1) below:

$$d/2<R\leq d \quad (1)$$

where d is a minimum opening width (mm) of the recessed portions at the inner wall surface of the mold copper plate, and R is an average radius of curvature (mm) of the recessed portions.

2. The continuous casting mold according to claim 1, wherein the radius of curvature is a constant value.

3. A method for continuously casting steel, the method comprising:

providing the continuous casting mold according to claim 2;

pouring molten steel in a tundish into the continuous casting mold; and continuously casting the molten steel.

4. The continuous casting mold according to claim 1, wherein an opening shape of one recessed portion at the inner wall surface of the mold copper plate is elliptic, and all adjacent recessed portions are not in contact with or connected to one another.

5. A method for continuously casting steel, the method comprising:

providing the continuous casting mold according to claim 4;

pouring molten steel in a tundish into the continuous casting mold; and continuously casting the molten steel.

6. The continuous casting mold according to claim 1, wherein an opening shape of one recessed portion at the inner wall surface of the mold copper plate is elliptic, and all or some adjacent recessed portions are in contact with or connected to one another.

7. A method for continuously casting steel, the method comprising:

providing the continuous casting mold according to claim 6;

pouring molten steel in a tundish into the continuous casting mold; and continuously casting the molten steel.

8. The continuous casting mold according to claim 1, wherein an opening shape of one recessed portion at the inner wall surface of the mold copper plate is circular, and all adjacent recessed portions are not in contact with or connected to one another.

9. A method for continuously casting steel, the method comprising:

providing the continuous casting mold according to claim 8;

pouring molten steel in a tundish into the continuous casting mold; and continuously casting the molten steel.

10. The continuous casting mold according to claim 1, wherein an opening shape of one recessed portion at the inner wall surface of the mold copper plate is circular, and all or some adjacent recessed portions are in contact with or connected to one another.

11. A method for continuously casting steel, the method comprising:

providing the continuous casting mold according to claim 10;

pouring molten steel in a tundish into the continuous casting mold; and continuously casting the molten steel.

12. A method for continuously casting steel, the method comprising:

providing the continuous casting mold according to claim 1;

pouring molten steel in a tundish into the continuous casting mold; and continuously casting the molten steel.

13. A continuous casting mold comprising:

a water-cooled copper mold having a mold copper plate including an inner wall surface;

recessed portions disposed partially or entirely in a region of the inner wall surface of the water-cooled copper mold from at least a position located at a meniscus to a position located 20 mm lower than the meniscus; and material-filled layers disposed in the recessed portions with a metal or nonmetal having a thermal conductivity different from that of the mold copper plate of the water-cooled copper mold, wherein a shape of each of the recessed portions at a surface of the mold copper plate, at any position of the recessed portion, is a curved surface having a curvature in every direction, and the curved surface has a radius of curvature satisfying the formula (1) below:

$$d/2<R\leq d \quad (1)$$

where d is a minimum opening width (mm) of the recessed portions at the inner wall surface of the mold copper plate, and R is an average radius of curvature (mm) of the recessed portions.

14. The continuous casting mold according to claim 13, wherein the radius of curvature is a constant value.

15. A method for continuously casting steel, the method comprising:

providing the continuous casting mold according to claim 14;

pouring molten steel in a tundish into the continuous casting mold; and continuously casting the molten steel.

16. A method for continuously casting steel, the method comprising:

providing the continuous casting mold according to claim 13;

pouring molten steel in a tundish into the continuous casting mold; and continuously casting the molten steel.

* * * * *